US011634304B2

(12) United States Patent
Okuda

(10) Patent No.: US 11,634,304 B2
(45) Date of Patent: Apr. 25, 2023

(54) ELEVATOR RENEWAL METHOD AND ELEVATOR AUXILIARY PANEL

(71) Applicant: Mitsubishi Electric Corporation, Tokyo (JP)

(72) Inventor: Seiji Okuda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 510 days.

(21) Appl. No.: 16/638,475

(22) PCT Filed: Aug. 18, 2017

(86) PCT No.: PCT/JP2017/029671

§ 371 (c)(1),
(2) Date: Feb. 12, 2020

(87) PCT Pub. No.: WO2019/035214

PCT Pub. Date: Feb. 21, 2019

(65) Prior Publication Data

US 2020/0216291 A1 Jul. 9, 2020

(51) Int. Cl.
*B66B 19/00* (2006.01)
*B66B 1/34* (2006.01)
(Continued)

(52) U.S. Cl.
CPC ..... *B66B 19/007* (2013.01); *B66B 1/3446* (2013.01); *B66B 1/468* (2013.01); *B66B 1/52* (2013.01); *B66B 2201/463* (2013.01)

(58) Field of Classification Search
CPC ..... B66B 1/3446; B66B 3/00; B66B 1/468; B66B 1/3423; B66B 5/0025; B66B 13/30;
(Continued)

(56) References Cited

FOREIGN PATENT DOCUMENTS

CN 111703991 A * 9/2020
JP 62-259973 A 11/1987
(Continued)

OTHER PUBLICATIONS

International Search Report and Written Opinion dated Oct. 31, 2017 for PCT/JP2017/029671 filed on Aug. 18, 2017, 12 pages including English Translation of the International Search Report.
(Continued)

*Primary Examiner* — Marlon T Fletcher
(74) *Attorney, Agent, or Firm* — Xsensus LLP

(57) ABSTRACT

An elevator renewal construction method includes steps of: replacing an old control panel of an existing elevator with a new control panel; installing an auxiliary panel, which includes a communication converter to be connected to the new control panel, and which is formed separately from the new control panel; and connecting an old device including at least any one of an old hall device and an old car device, which has been placed in a communicable state with the old control panel of the existing elevator, into a communicable state with the new control panel via the communication converter, wherein the new control panel is configured to be communicable with the old device through an old communication system converted via the communication converter included in the auxiliary panel, the communication converter being configured to mutually convert a communication system between a new communication system and the old communication system.

12 Claims, 9 Drawing Sheets

(51) Int. Cl.
*B66B 1/46* (2006.01)
*B66B 1/52* (2006.01)

(58) Field of Classification Search
CPC B66B 11/0226; B66B 19/007; B66B 2201/30
See application file for complete search history.

(56) References Cited

FOREIGN PATENT DOCUMENTS

| | | | | | |
|---|---|---|---|---|---|
| JP | H04-298469 | A | 10/1992 | | |
| JP | 4-333483 | A | 11/1992 | | |
| JP | 5-24068 | B2 | 4/1993 | | |
| JP | 2000-203771 | A | 7/2000 | | |
| JP | 2000-211844 | A | 8/2000 | | |
| JP | 2006-264840 | A | 10/2006 | | |
| JP | 2011-162294 | A | 8/2011 | | |
| JP | 2012-12161 | A | 1/2012 | | |
| JP | 2015-231903 | A | 12/2015 | | |
| JP | 5851263 | B2 | 2/2016 | | |
| JP | 7058660 | B2 * | 4/2022 | ..... | B66B 1/3446 |
| WO | 99/26131 | A1 | 5/1999 | | |
| WO | WO-2018109946 | A1 * | 6/2018 | ..... | B66B 1/3407 |
| WO | WO-2019035214 | A1 * | 2/2019 | ..... | B66B 1/3446 |

OTHER PUBLICATIONS

Japanese Office Action dated Nov. 24, 2021, in corresponding Japanese Patent Application No. 2019-536406.
Office Action dated Mar. 23, 2021, in corresponding Japanese patent Application No. 2019-536406, 18 pages.

* cited by examiner

FIG.2

| DIVIDED WORK-EXECUTION STEP | DETAILS OF RENEWAL | MAIN DEVICE TO BE REPLACED |
|---|---|---|
| STEP 1 | IMPROVEMENT OF MACHINE ROOM | CONTROL PANEL AND SO ON |
| STEP 2 | IMPROVEMENT OF CAR | ON-CAR STATION, DOOR DRIVING DEVICE, CAR OPERATING PANEL, TRAVELING CABLE, AND SO ON |
| STEP 3 | IMPROVEMENT OF HOISTWAY AND HALL | HALL OPERATING PANEL, TERMINAL SLOWDOWN SWITCH, HOISTWAY CABLE, AND SO ON |
| STEP 4 | REPLACEMENT OF TRACTION MACHINE | TRACTION MACHINE, MAIN ROPE, WEIGHING DEVICE, AND SO ON |
| STEP 5 | WORK FOR EARTHQUAKE SAFETY | S-WAVE SEISMIC SENSOR AND SO ON |

FIG.3

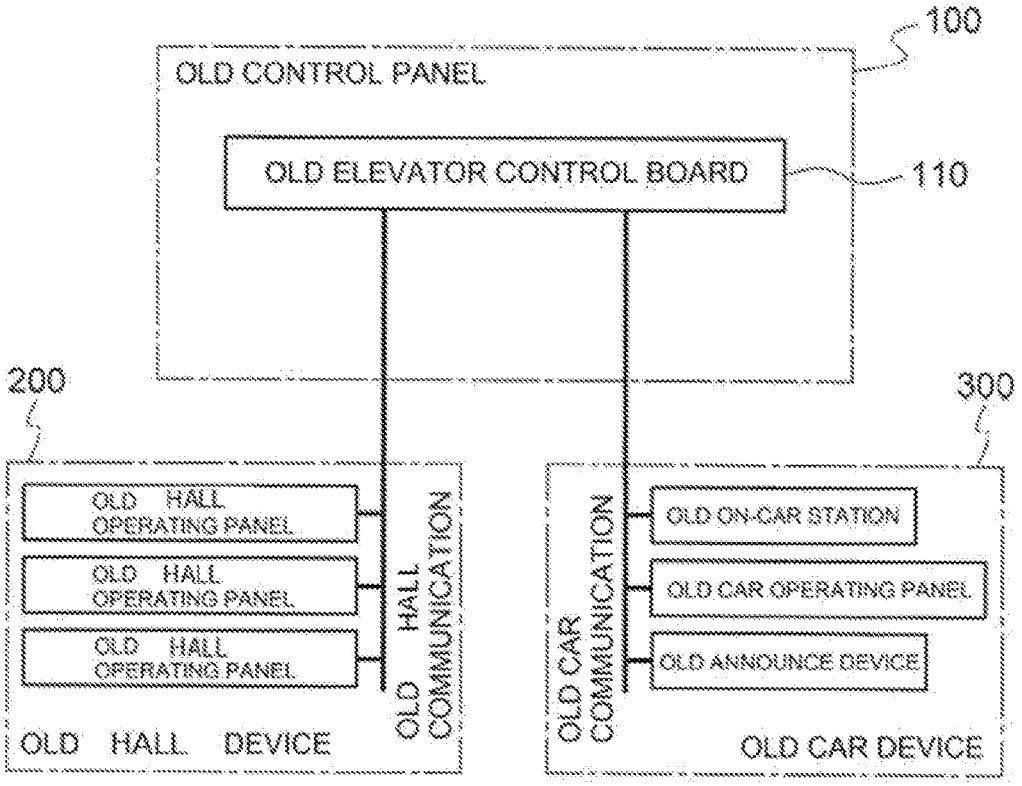

ELEVATOR RENEWAL METHOD AND ELEVATOR AUXILIARY PANEL

CROSS-REFERENCE TO RELATED APPLICATIONS

The present application is based on PCT filing PCT/JP2017/029671, filed Aug. 18, 2017, the entire contents of which are incorporated herein by reference.

TECHNICAL FIELD

The present invention relates to an elevator renewal construction method for renewing at least one device in an existing elevator and to an elevator auxiliary panel to be used for renewal of an elevator.

BACKGROUND ART

In order to cope with aging degradation of a device or to improve performance such as energy saving performance, elevator renewal for replacing an existing elevator with a new elevator is performed. During an elevator renewal construction period, an operation of the elevator is required to be continuously suspended for a long period of time.

Thus, for example, especially in a condominium or a hospital with a large number of elderly people, a long elevator out-of-service period has been a major obstacle to the renewal. Accordingly, in the renewal of the elevator, a continuous elevator out-of-service period is required to be shortened as much as possible in view of convenience of a user.

In order to shorten the continuous elevator out-of-service period, there is proposed an elevator controller including a new transmission control unit and a new/old transmission conversion unit. The new transmission control unit uses a new serial transmission system different from an old serial transmission system at least in data transmission speed. The new/old transmission conversion unit includes a new transmission control CPU, an old transmission control CPU, and a dual-port memory. The new transmission control CPU is connected to the new transmission control unit. The old transmission control CPU is connected to an old transmission control unit of the old serial transmission system, which is provided on a hall side. The dual-port memory is connected to both of the new transmission control CPU and the old transmission control CPU. The dual-port memory stores data of the old serial transmission system, which is transmitted from an old transmission conversion unit provided on the hall side, via the old transmission control CPU and retains the thus stored data so that the stored data is accessible from the new transmission control unit via the new transmission control CPU. Meanwhile, the dual-port memory stores data of the new serial transmission system, which is transmitted from the new transmission control unit, via the new transmission control CPU and retains the thus stored data so that the stored data is accessible from the old transmission conversion unit provided on the hall side via the old transmission control CPU (see, for example, Patent Literature 1).

CITATION LIST

Patent Literature

[PTL 1] JP 5851263 B2

SUMMARY OF INVENTION

Technical Problem

In the elevator renewal construction method using the elevator controller, which is described in Patent Literature 1, however, time required for renewal of an elevator control panel is shortened with continuous use of components used in an existing elevator without replacement thereof. Thus, there is a problem in that the above-mentioned elevator renewal construction method does not contribute to the shortening of the continuous elevator out-of-service period in the elevator renewal for replacing the existing elevator with the new elevator.

Further, in the elevator controller described in Patent Literature 1, the elevator control panel is required to include the new transmission control CPU, the old transmission control CPU, and the dual-port memory so that the elevator controller converts transmission signals to be transmitted in the different transmission systems and retains the converted transmission signals. Hence, there are problems in that a configuration becomes complex and that cost increases.

The present invention has been made to solve the problems described above, and has an object to provide an elevator renewal construction method, with which a continuous elevator out-of-service period in a renewal construction period for renewing at least one device in an existing elevator can be shortened, and an elevator auxiliary panel having a simple configuration, with which cost can be reduced.

Solution to Problem

According to one embodiment of the present invention, there is provided an elevator renewal construction method for renewing at least one device in an existing elevator, including the steps of: replacing an old control panel of the existing elevator with a new control panel; installing an auxiliary panel, which includes a communication conversion unit to be connected to the new control panel, and which is formed separately from the new control panel; and connecting an old device including at least any one of an old hall device and an old car device, which has been placed in a communicable state with the old control panel of the existing elevator, into a communicable state with the new control panel via the communication conversion unit, wherein the new control panel is configured to be communicable with the old device through an old serial communication system converted via the communication conversion unit included in the auxiliary panel, the communication conversion unit being configured to mutually convert a communication system between a new serial communication system and the old serial communication system.

There is provided an elevator auxiliary panel according to the method which is formed separately from an elevator control panel including an elevator control unit configured to control a device in an elevator through a new serial communication system being different from an old serial communication at least in data transmission speed, the elevator auxiliary panel including a communication conversion unit, which is to be connected to the elevator control unit of the elevator control panel, and which is configured to mutually convert a communication system between the old serial communication system and the new serial communication system.

Advantageous Effects of Invention

According to one embodiment of the present invention, it is possible to obtain the elevator renewal construction method, with which the continuous elevator out-of-service period in the renewal construction period for renewing at least one device in the existing elevator can be shortened, and the elevator auxiliary panel having a simple configuration, with which cost can be reduced.

BRIEF DESCRIPTION OF DRAWINGS

FIG. 2 is an explanatory table for showing details of renewal and main devices to be replaced in divided construction work steps in the elevator renewal construction method according to the first embodiment of the present invention.

FIG. 3 is a block configuration diagram for illustrating an initial state in the elevator device to which the elevator renewal construction method according to the first embodiment of the present invention is to be applied.

DESCRIPTION OF EMBODIMENT

A description is now given of an elevator renewal construction method and an elevator auxiliary panel to be used for renewal of an elevator according to preferred embodiments of the present invention with reference to the accompanying drawings, and throughout the drawings, like or corresponding components are denoted by like reference symbols to describe those components. In addition, an elevator control panel is hereinafter simply referred to also as "control panel", and the elevator auxiliary panel is hereinafter simply referred to also as "auxiliary panel".

First Embodiment

Figure 1:
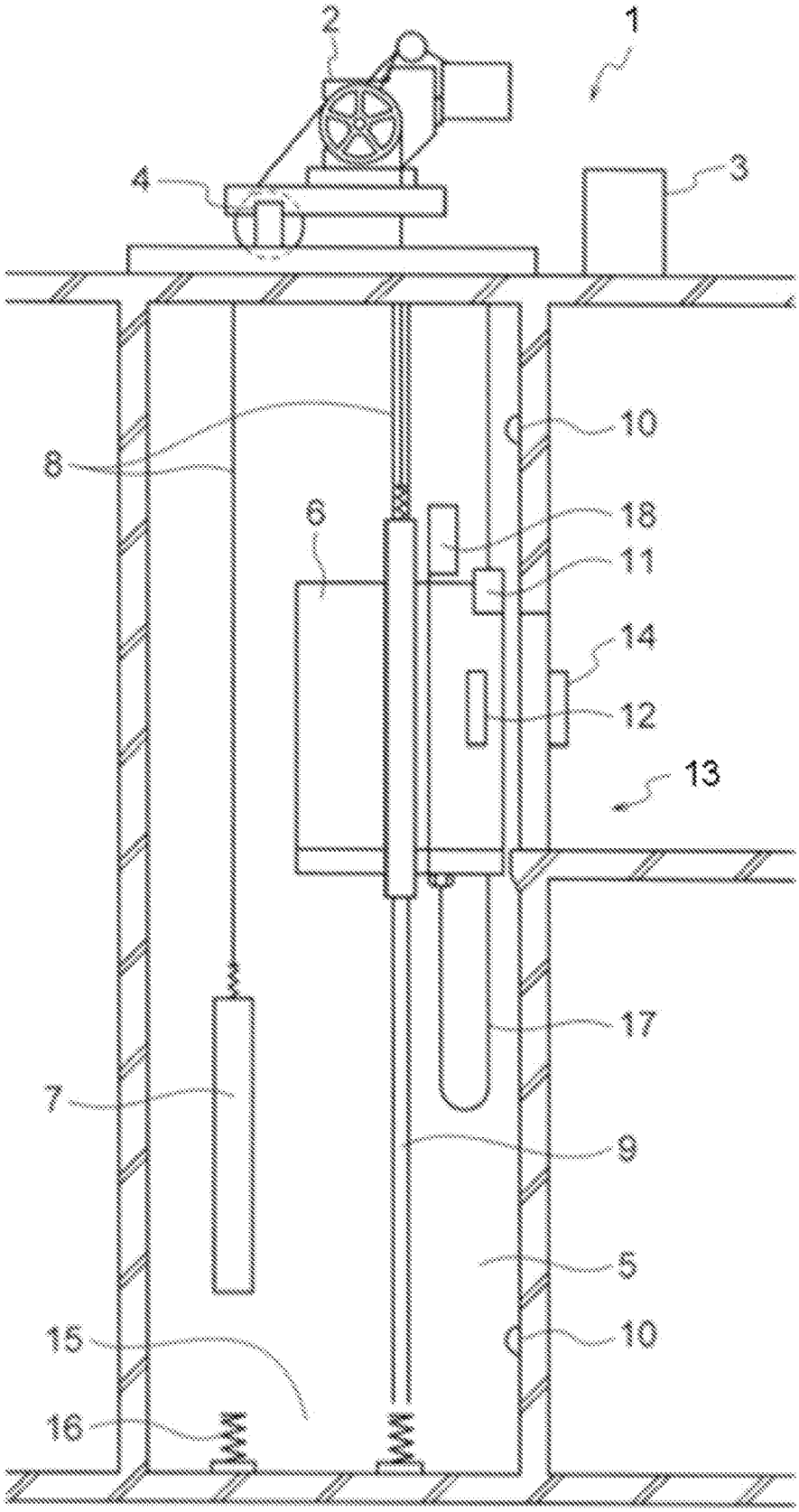
FIG. 1 is a configuration view for illustrating an elevator device to which an elevator renewal construction method according to a first embodiment of the present invention is to be applied.

FIG. 1 is a configuration view for illustrating an elevator device to which an elevator renewal construction method according to a first embodiment of the present invention is to be applied. In FIG. 1, in a machine room 1, there are provided a traction machine 2 including a traction motor, a control panel 3, and a speed governor 4. In a hoistway 5, there are provided a car 6, a counterweight 7, a main rope 8, guide rails 9, and a terminal slowdown switch 10. The main rope 8 is configured to connect the car 6 and the counterweight 7. A door driving device 11, which includes a door motor, and a car operating panel 12 are provided to the car 6. A hall operating panel 14 is provided at a hall 13. Buffers 16 are provided in a pit 15. The control panel 3 and an on-car station 18 are connected to each other through a traveling cable 17. The on-car station 18 and a car device are connected to each other. The on-car station 18 has a door opening/closing control function and a relaying function with another car device.

In this case, the "car device" denotes a device provided to and around the car, such as the door driving device 11, the car operating panel 12, and the on-car station 18. The "hall device" denotes a device provided at and around the hall, such as the hall operating panel 14. A "hoistway device" denotes, for example, the terminal slowdown switch 10 and a hoistway cable not shown in FIG. 1.

In the first embodiment of the present invention, in order to shorten a continuous elevator out-of-service period in an elevator renewal construction period, renewal construction work is divided into a plurality of divided construction work steps. At the same time, there is developed the elevator control panel capable of controlling, for example, both of a new traction machine and an old traction machine so that the elevator is available after completion of each of the divided construction work steps.

Specifically, the shortening of the continuous elevator out-of-service period in the elevator renewal construction period presupposes the availability of the elevator at the time of completion of each of the divided construction work steps of the renewal construction work. For example, in a condominium, the elevator is required to be available in morning and night hours in which a large number of users use the elevator for, for example, commuting to and from work and school. In a restaurant tenant building, the elevator is required to be available in, for example, evening and night business hours.

Thus, work time that can be ensured for one day is set. Based on a result of analysis of details of work and time required for each part of work, the details of work, which can be completed within the time, are set for each of the divided construction work steps. Specifically, a process of the renewal construction work is divided into a series of divided construction work steps each determined as such a unit that the elevator becomes normally operable every time after finishing of each of the divided construction work steps. Further, the renewal construction work is carried out in accordance with the series of divided construction work steps. Now, the details of renewal and main devices to be replaced in the divided construction work steps are shown in FIG. 2. In FIG. 2, the renewal construction work is divided mainly into five divided construction work steps. However, the divided construction work steps are required to be organized into groups depending on specifications of the elevator.

More specifically, after a series of the divided-construction work steps of replacing old devices with new devices are organized into groups, between which an elevator available time period is set, the renewal construction work is carried out. Further, the elevator available time period is determined in accordance with a frequency of activation of the elevator before the renewal and a purpose of use of a building. Further, the renewal construction work is carried out after the divided construction work steps are organized into the divided construction work step groups, each of which is completed in the least work time ensured for one day and after which the elevator is available. Specifically, the series of divided construction work steps are determined so that each of the divided construction work steps is completed in a corresponding one of a series of construction periods, which are each ensured without interruption for each renewal construction work day in a renewal construction period. Specifically, a normal operation mode and an installation work mode are set. Each time the divided construction work step is completed, the installation work mode is switched to the normal operation mode to bring the elevator into a service available state so as to perform a normal operation for providing elevator service to a passenger.

(Renewal Construction Method)

Subsequently, with reference to FIG. 3 to FIG. 12 together with FIG. 1 and FIG. 2, an elevator renewal construction method according to the first embodiment of the present invention is described. FIG. 3 is a block configuration diagram for illustrating an initial state in the elevator device to which the elevator renewal construction method according to the first embodiment of the present invention is to be applied.

In FIG. 3, when the elevator device is in the initial state, an old hall device 200 and an old car device 300 are connected to an old control panel 100 before replacement, through an old serial communication system. The old control panel 100 includes an old elevator control board 110 configured to control, for example, operations of the old hall device 200, the old car device 300, and the old traction machine (not shown).

(Divided Construction Work Step 1: Machine Room Improvement)

Figure 4:
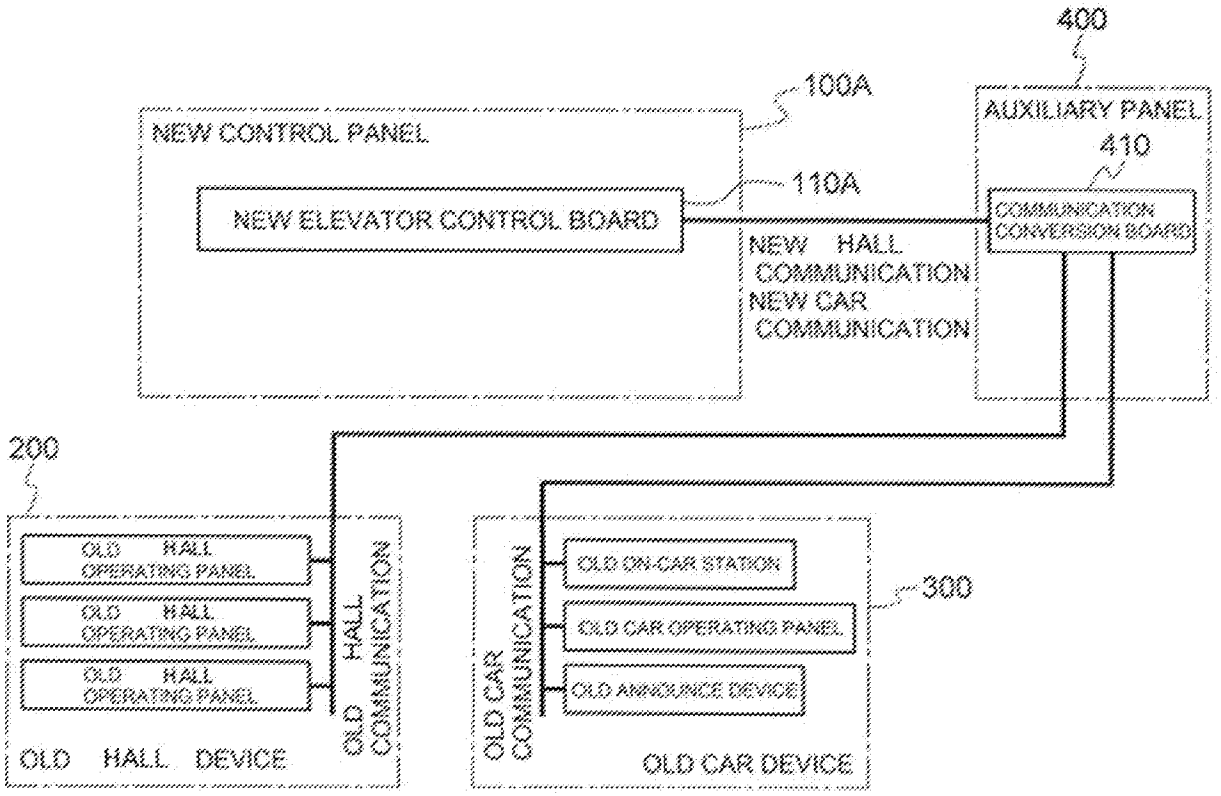
FIG. 4 is a block configuration diagram for illustrating a state after replacement of a control panel in the elevator device to which the elevator renewal construction method according to the first embodiment of the present invention is applied.

For the elevator device, in a divided construction work step 1 shown in FIG. 2, the elevator control panel is replaced. Specifically, in the divided construction work step 1, an old control panel of an existing elevator is replaced with a new control panel. Further, in the divided construction work step 1, an auxiliary panel, which is formed separately from the new control panel, is additionally installed. FIG. 4 is a block configuration diagram for illustrating a state after the replacement of the control panel in the elevator device to which the elevator renewal construction method according to the first embodiment of the present invention is applied.

The reason why the elevator control panel is first replaced in the divided construction work step 1 is as follows. When the hall device or the car device is first replaced, exchange of information with the replaced device increases. Thus, it becomes difficult to deal with the exchange of the information with the existing elevator control panel to give rise to the need of modification. Thus, when the hall device or the car device is replaced after the elevator control panel is first replaced in the divided construction work step 1, a new elevator control panel, which is provided after the replacement, can deal with the exchange of the information with a new hall device or a new car device.

In FIG. 4, the old control panel 100 is replaced with a new control panel 100A. Further, an auxiliary panel 400, which includes a communication conversion board 410 to be connected to the new control panel 100A and is formed separately from the new control panel 100A, is installed. The old hall device 200 and the old car device 300 are connected to the new control panel 100A via the auxiliary panel 400. Further, the new control panel 100A includes a new elevator control board 110A in place of the old elevator control board 110 illustrated in FIG. 3.

Figure 5:
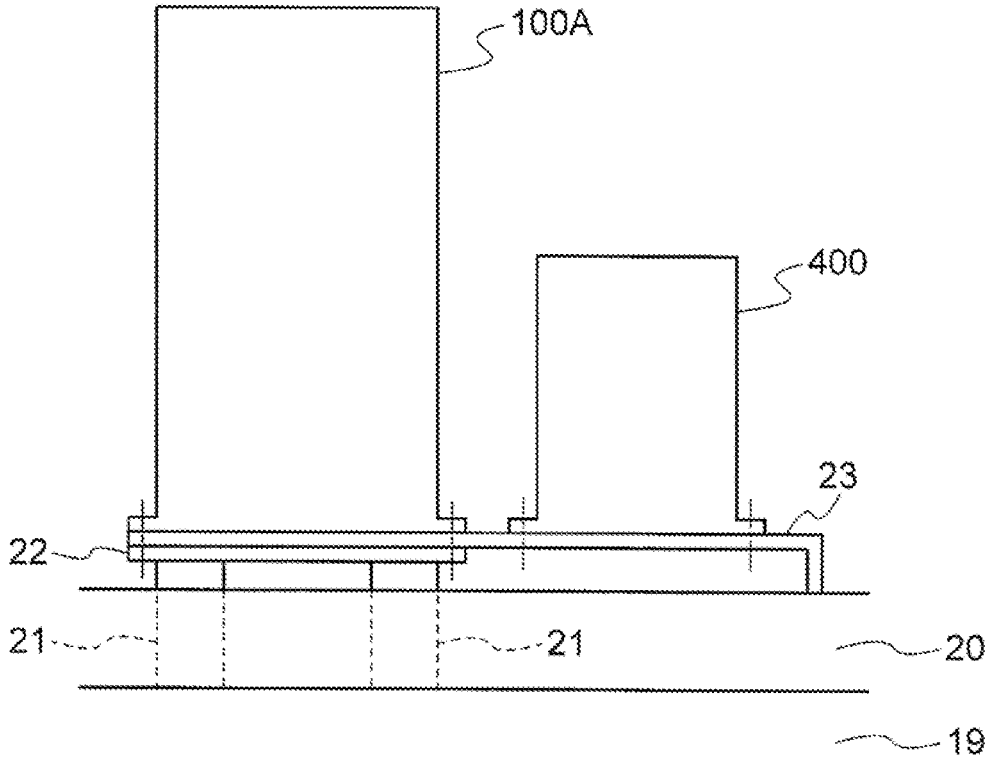
FIG. 5 is a schematic view for illustrating a first example of a method of installing an elevator auxiliary panel in the elevator renewal construction method according to the first embodiment of the present invention.

Now, specific examples of a method of installing the auxiliary panel 400 in the machine room are described with reference to FIG. 5 to FIG. 7.

First, a first example of the method of installing the auxiliary panel 400 is described with reference to FIG. 5. FIG. 5 is a schematic view for illustrating the first example of the method of installing the elevator auxiliary panel in the elevator renewal construction method according to the first embodiment of the present invention.

In this case, in general, support legs 21 configured to support the old control panel 100 are in a state of being embedded in cinder concrete 20 laid on a floor 19 of the machine room. As illustrated in FIG. 5, when the old control panel 100 is replaced with the new control panel 100A, the new control panel 100A is fixed on a support plate 22 under a state in which a fixing member 23 having an L-like sectional shape is inserted between the support plate 22 arranged on the support legs 21 and the new control panel 100A. One end of the fixing member 23 is supported on the cinder concrete 20. The auxiliary panel 400 is fixed onto the fixing member 23.

As described above, in a step of installing the auxiliary panel 400, the auxiliary panel 400 is fixed onto the fixing member 23, which is inserted between the support plate 22 arranged on the support legs 21 configured to support the new control panel 100A and the new control panel 100A. Thus, the auxiliary panel 400 is not required to be fixed onto the cinder concrete 20 with use of anchors, and the auxiliary panel 400 can easily be installed.

Subsequently, a second example of the method of installing the auxiliary panel 400 is described with reference to FIG. 6. FIG. 6 is a schematic view for illustrating the second example of the method of installing the elevator auxiliary panel in the elevator renewal construction method according to the first embodiment of the present invention.

Figure 6:
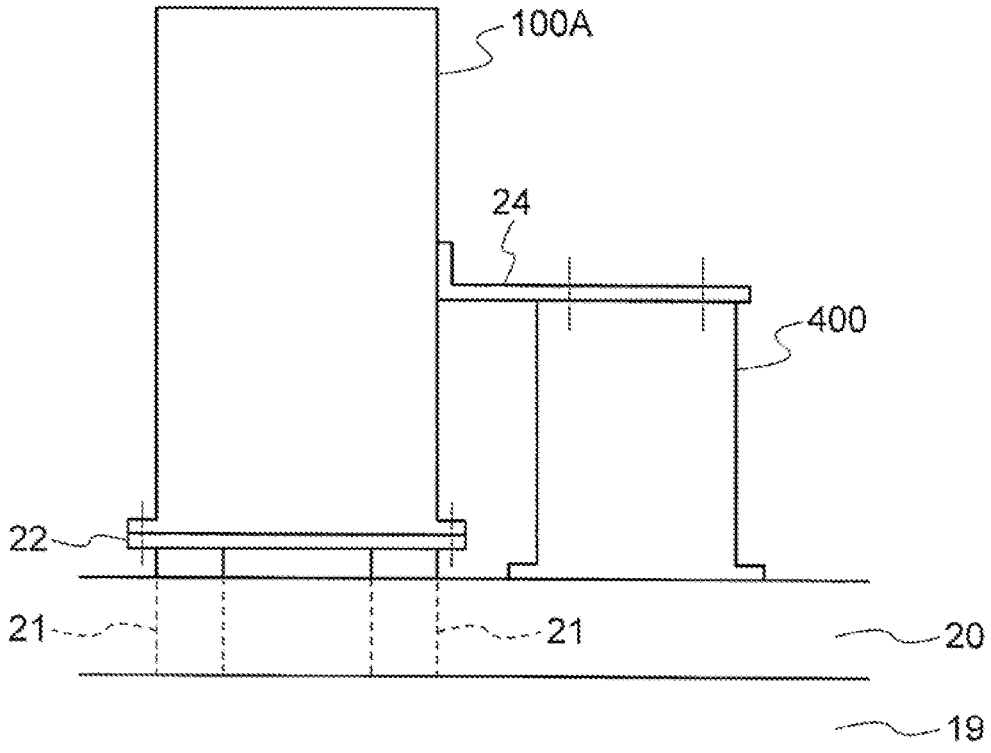
FIG. 6 is a schematic view for illustrating a second example of the method of installing the elevator auxiliary panel in the elevator renewal construction method according to the first embodiment of the present invention.

As illustrated in FIG. 6, when the old control panel 100 is replaced with the new control panel 100A, the new control panel 100A is fixed onto the support plate 22 arranged on the support legs 21. Further, one end of a fixing member 24 having an L-like sectional shape is mounted to a side of the new control panel 100A. The auxiliary panel 400 is installed on the cinder concrete 20, and a top of the auxiliary panel 400 is fixed to the fixing member 24.

As described above, in the step of installing the auxiliary panel 400, the auxiliary panel 400 is fixed by fixing the top of the auxiliary panel 400 to the fixing member 24 mounted to the side of the new control panel 100A. Thus, as in the first example described above, the auxiliary panel 400 is not required to be fixed onto the cinder concrete 20 with use of anchors.

Subsequently, a third example of the method of installing the auxiliary panel 400 is described with reference to FIG.

7. FIG. 7 is a schematic view for illustrating the third example of the method of installing the elevator auxiliary panel in the elevator renewal construction method according to the first embodiment of the present invention.

Figure 7:
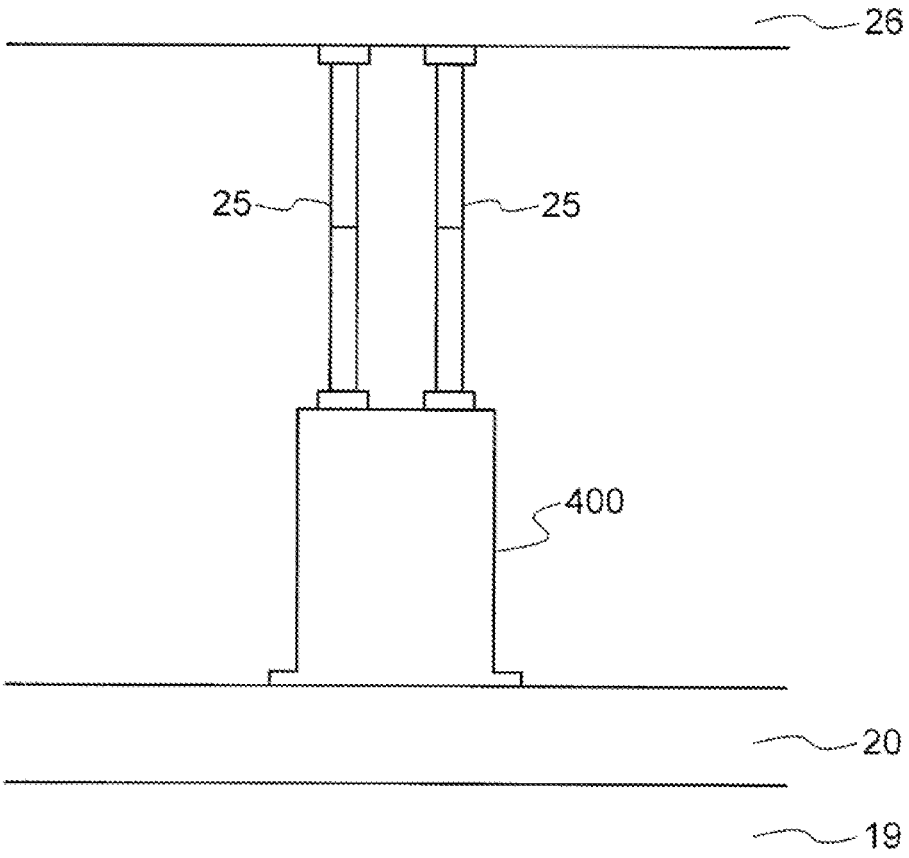
FIG. 7 is a schematic view for illustrating a third example of the method of installing the elevator auxiliary panel in the elevator renewal construction method according to the first embodiment of the present invention.

As illustrated in FIG. 7, the auxiliary panel 400 is installed on the cinder concrete 20. Further, the auxiliary panel 400 is fixed under a state in which tension rods 25 are applying forces to the top of the auxiliary panel 400 and a ceiling 26 of the machine room. The tension rods 25 are provided between the top of the auxiliary panel 400 and the ceiling 26. Each of the tension rods 25 is configured so that a length in a height direction is adjustable.

As described above, in the step of installing the auxiliary panel 400, the tension rods 25 provided between the top of the auxiliary panel 400 and the ceiling 26 of the machine room apply forces to the top of the auxiliary panel 400 and the ceiling 26 to thereby fix the auxiliary panel 400. Thus, as in the first and second examples described above, the auxiliary panel 400 is not required to be fixed onto the cinder concrete 200 with use of anchors.

Returning back to the description of FIG. 4, the new elevator control board 110A has not only a function of controlling operations of, for example, a new hall device, a new car device, and a new traction machine, which are described later, but also a function of controlling operations of the old hall device 200, the old car device 300, and the old traction machine with change of setting of parameters in accordance with each of the divided construction work steps shown in FIG. 2.

However, the new elevator control board 110A communicates with the new car device through a new serial communication system, for example, a controller area network (CAN) communication system, which enables transmission and reception of a larger capacity of data than that through an old serial communication system. Thus, the new elevator control board 110A and the old car device 300 cannot directly communicate with each other. As an example of the old serial communication system, a communication speed of 4,800 bps is given. As an example of the CAN communication system, a communication speed of 122.88 kbps is given. Thus, a data transmission speed of the new serial communication system is about 10 times or higher than a data transmission speed of the old serial communication system.

Further, a larger capacity of data can be transmitted and received through communication through the CAN communication system than through the old serial communication system. Thus, a display device mounted in the new car device has the effect of displaying a larger capacity of data than on a display device mounted in the old car device. A new function, which is not provided to the old car device, for example, a touch-type car operating function integral with the display device, can be achieved in the new car device.

The specific contents to be transmitted and received through the communication between the new elevator control board 110A and the old car device 300 includes, for example, state information of the door driving device 11, a display command for the car operating panel 12, operation information of a button and a switch of the car operating panel 12 etc., and an announce command.

Figure 8:
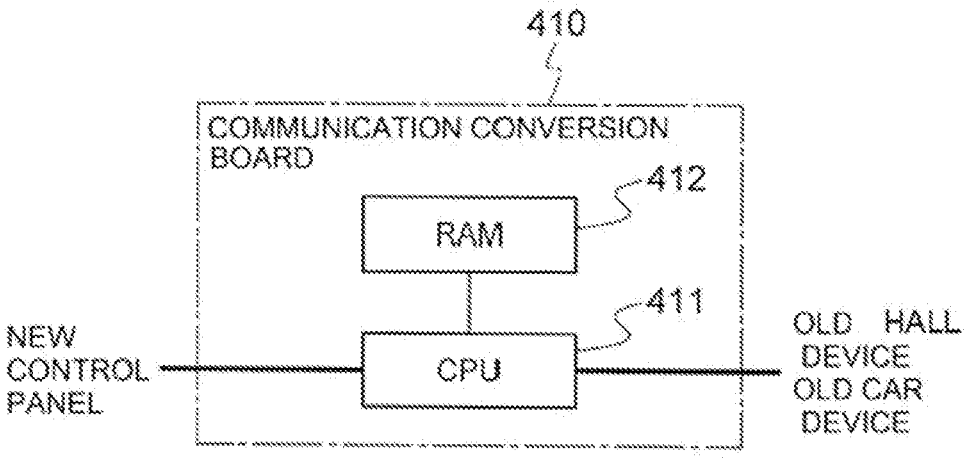
FIG. 8 is a hardware configuration diagram for illustrating a communication conversion board in the elevator auxiliary panel according to the first embodiment of the present invention.

Thus, the new control panel 100A is connected to the auxiliary panel 400 including the communication conversion board 410 serving as a communication conversion unit configured to mutually convert a communication system between the old serial communication system and the new serial communication system (CAN communication system). Further, the auxiliary panel 400 is connected to the old car device 300. The same description as that of the old car device 300 can be given for the old hall device 200. The auxiliary panel 400 is connected to the old hall device 200. FIG. 8 is a hardware configuration diagram for illustrating the communication conversion board in the elevator auxiliary panel according to the first embodiment of the present invention. In FIG. 8, the communication conversion board 410 includes a CPU 411 and a RAM 412. In FIG. 8, the communication conversion board 410 including one CPU and one memory is exemplified.

The CPU 411 is configured to convert a format of data transmitted from the new elevator control board 110A to a format of data compatible with the old car device 300 and store the data in the RAM 412. Further, the CPU 411 is configured to convert a format of data transmitted from the old car device 300 to a format of data compatible with the new elevator control board 110A and store the data in the RAM 412. The format refers to a data structure such as the number of bits.

Further, the CPU 411 is configured to extract and output the format-converted data from the RAM 412 in accordance with a request from the new elevator control board 110A. The CPU 411 is also configured to extract and output the format-converted data from the RAM 412 in accordance with a request from the old car device 300. In this manner, the new elevator control board 110A and the old car device 300 can mutually communicate with each other via the communication conversion board 410. The same description as that of the old car device 300 can be given for the old hall device 200. The new elevator control board 110A and the old hall device 200 can mutually communicate with each other via the communication conversion board 410.

With use of the communication conversion board 410, even when, for example, a transmission cycle is not changed, the communication speed increases. Therefore, a data amount transmittable per cycle increases. Further, with the increase in data amount, an error check function can be enhanced.

As described above, the auxiliary panel 400 including the communication conversion board 410 is formed separately from the new control panel 100A. After the replacement of the hall device and the car device, which is described later, the hall device and the car device can directly communicate with the new elevator control board 110A without via the communication conversion board 410. Thus, the auxiliary panel 400 including the communication conversion board 410 is no longer needed.

Thus, after the auxiliary panel 400 is no longer needed, the auxiliary panel 400 is removed from a present place and is installed at another place. As a result, the auxiliary panel 400 can be reused at the another place, and hence cost can be reduced. Specifically, the removed auxiliary panel 400 can be used for renewal construction work at the another place. Hence, with the reuse of the auxiliary panel 400, resource saving measures can be implemented.

In this case, there has been exemplified the case in which the old hall device 200 and the old car device 300 are brought into a communicable state with the new elevator control board 110A of the new control panel 100A via the communication conversion board 410 of the auxiliary panel 400. However, the connection of the old devices is not limited thereto.

Specifically, old devices, which can be brought into a communicable state with the new control panel 100A even without use of the communication conversion board 410, may be connected to the new control panel 100A without via the communication conversion board 410. As described above, the old device including at least any one of the old hall device 200 and the old car device 300, which has been placed in a communicable state with the old control panel 100, is brought into a communicable state with the new control panel 100A via the communication conversion board 410.

In the above-mentioned manner, after the step of replacing the old control panel of an existing elevator with the new control panel, the new control panel 100A controls the old hall device 200 and the old car device 300 via the communication conversion unit (communication conversion board 410). Specifically, the new control panel 100A is configured to be communicable with the old device including at least any one of the old hall device 200 and the old car device 300 through the old serial communication system after the communication system is converted from the new serial communication system into the old serial communication system via the communication conversion board 410 included in the auxiliary panel 400. As a result, the normal operation for providing the elevator service to the passenger can be performed. Thus, the passenger can use the elevator between the steps of the renewal construction work. Accordingly, the continuous elevator out-of-service period in the elevator renewal construction period can be shortened.

(Divided Construction Work Step 2: Car Improvement) and (Divided Construction Work Step 3: Hoistway and Hall Improvement)

Figure 9:
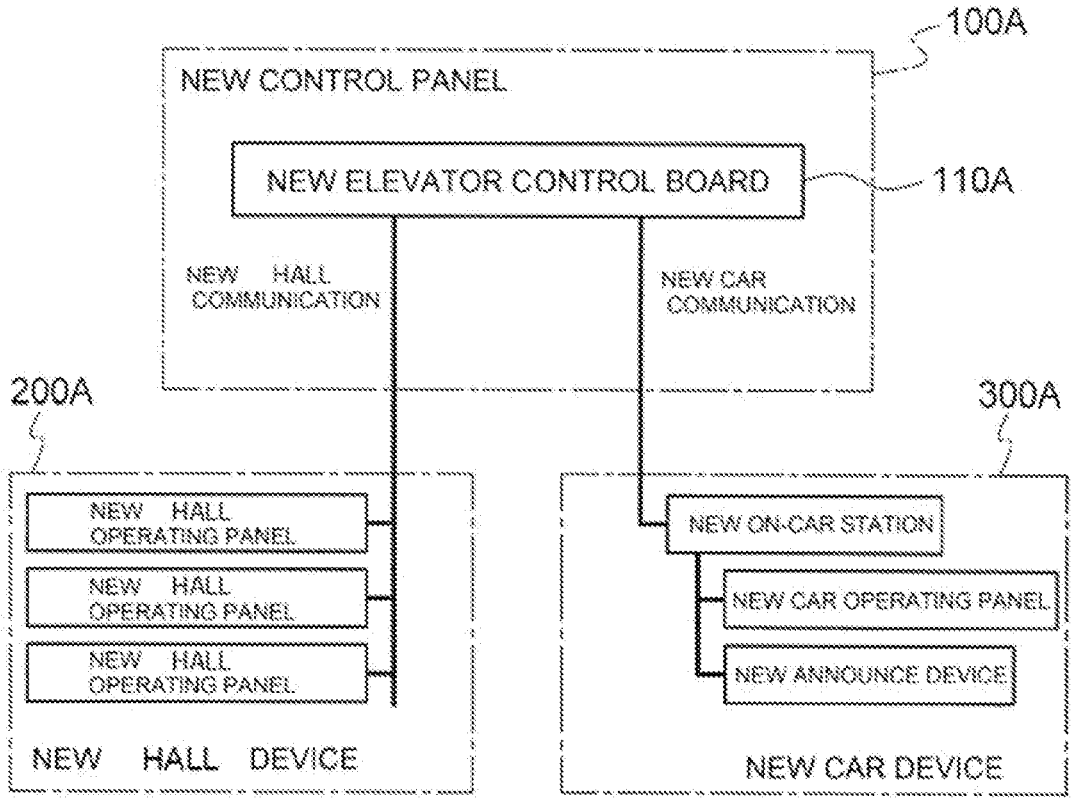
FIG. 9 is a block configuration diagram for illustrating a state after replacement of a hall device and a car device in the elevator device to which the elevator renewal construction method according to the first embodiment of the present invention is applied.

Next, for the elevator device, the car device is replaced in a divided construction work step 2 shown in FIG. 2, and the hall device and the hoistway device are replaced in the divided construction work step 3 shown in FIG. 2. In the divided construction work step 3, only representative hall devices are described. Any of the divided construction work step 2 and the divided construction work step 3 may be first carried out. FIG. 9 is a block configuration diagram for illustrating a state after the replacement of the hall device and the car device in the elevator device to which the elevator renewal construction method according to the first embodiment of the present invention is applied.

The old device is replaced with a corresponding new device including at least any one of a new hall device 200A and a new car device 300A, and the new device is brought into a communicable state with the new control panel 100A. More specifically, in FIG. 9, the old hall device 200 and the old car device 300 are replaced with the new hall device 200A and the new car device 300A, respectively. Further, after old cables are replaced with new cables, the new hall device 200A and the new car device 300A are connected to the new control panel 100A through the new cables.

In the divided construction work step 1, cables for old devices are continuously used in accordance with continuous use of the old hall device 200 and the old car device 300. In this case, the old cables for old devices, which have been connected to the old control panel 100, are described separately for the old cable to be connected to the new control panel 100A and the old cable to be connected to the communication conversion board 410 included in the auxiliary panel 400. Thus, the following conditions are considered. Specifically, the old hall device 200 is brought into a communicable state with the new control panel 100A without via the communication conversion board 410, and the old car device 300 is brought into a communicable state with the new control panel 100A via the communication conversion board 410. In this case, the old cable for the old hall device 200, which has connected the old hall device 200 and the old control panel 100 to each other, is connected to the new control panel 100A, and the old cable for the old car device 300, which has connected the old car device 300 and the old control panel 100 to each other, is connected to the communication conversion board 410.

However, a kind of a connector for the old cable for the old hall device 200 and a circuit thereof are different from those of a connector provided to the new control panel 100A. Hence, the connectors described above cannot be directly connected to each other. Similarly, a kind of a connector for the old cable for the old car device 300 and a circuit thereof are different from those of a connector provided to the auxiliary panel 400. Hence, the connectors described above cannot be directly connected to each other.

Figure 10:
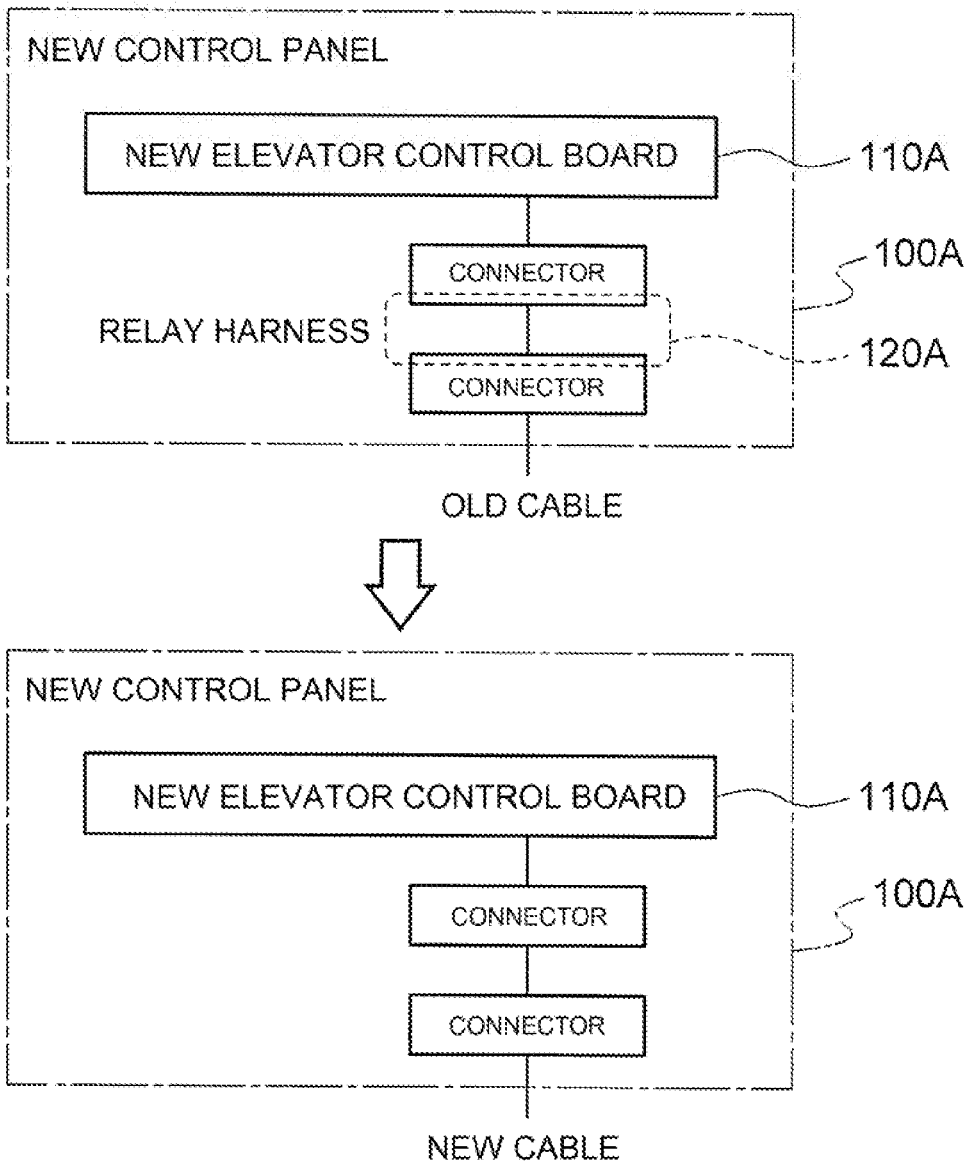
FIG. 10 is an explanatory diagram for illustrating a connection relationship of a cable in the elevator device to which the elevator renewal construction method according to the first embodiment of the present invention is applied.
Figure 11:
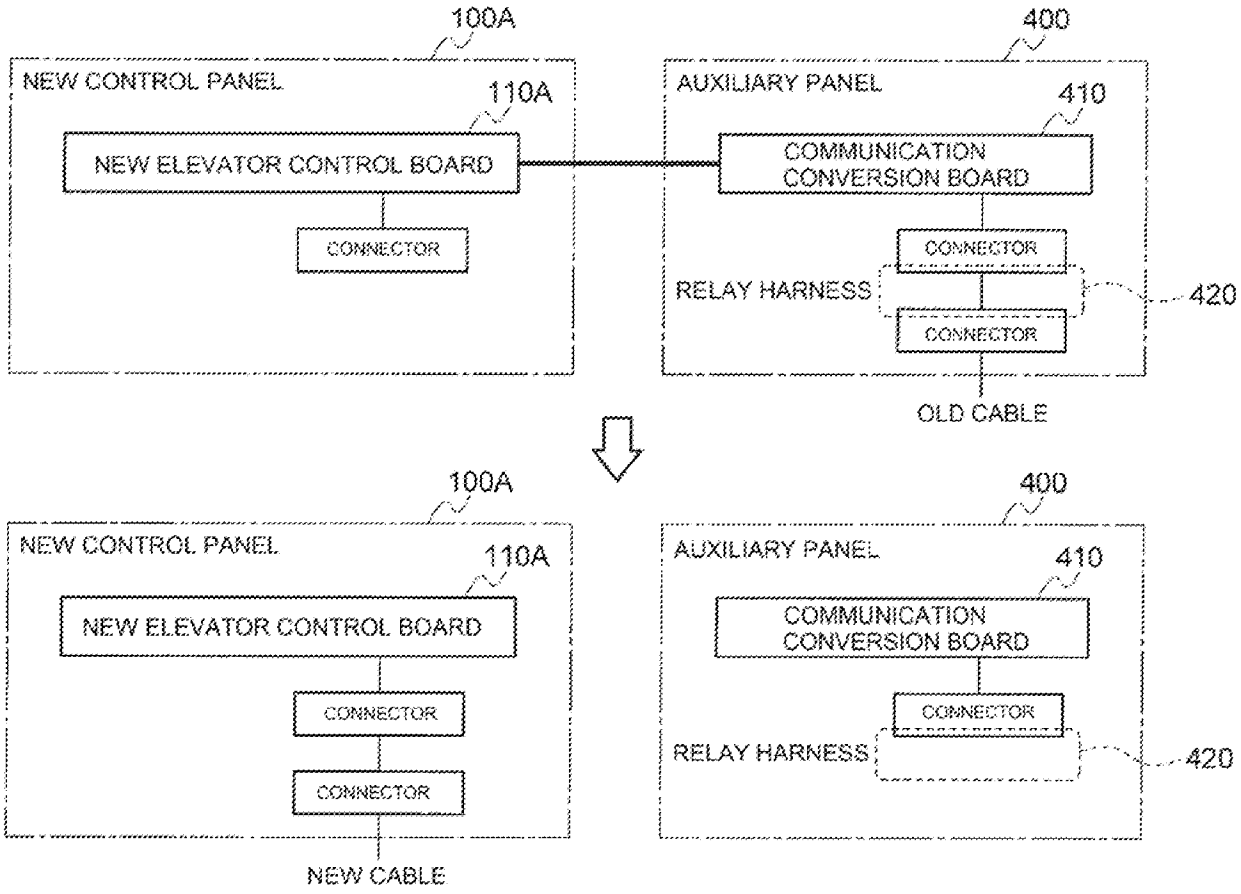
FIG. 11 is an explanatory diagram for illustrating a connection relationship of cables in the elevator device to which the elevator renewal construction method according to the first embodiment of the present invention is applied.

Thus, as illustrated in FIG. 10, a relay harness 120A is connected to the new control panel 100A. Further, as illustrated in FIG. 11, a relay harness 420 is connected to the auxiliary panel 400. FIG. 10 and FIG. 11 are explanatory views each for illustrating a connection relationship between cables in the elevator device to which the elevator renewal construction method according to the first embodiment of the present invention is applied.

In FIG. 10 and FIG. 11, in the divided construction work step 1, the old cable for the old hall device 200 is connected to the relay harness 120A, and the old cable for the old car device 300 is connected to the relay harness 420. The relay harness 120A has a connector compatible with the old cable for the old hall device 200. Further, the relay harness 420 has a connector compatible with the old cable for the old car device 300. As described above, the old cable for the old hall device 200 is connected to the new control panel 100A via the relay harness 120A, and the old cable for the old car device 300 is connected to the communication conversion board 410 included in the auxiliary panel 400 via the relay harness 420. Specifically, when the old device and the communication conversion board 410 are connected to each other through the old cable, the old cable is connected to the communication conversion board 410 via the relay harness having the connector compatible with the old cable.

After the new control panel 100A and the old car device 300 are connected to each other through the old cable, the new control panel 100A converts the new serial communication system into the old serial communication system via the communication conversion board 410 included in the auxiliary panel 400 and through the old cable so as to enable control of the old car device 300 through the old serial communication system. Further, the new control panel 100A controls the old car device 300 via the communication conversion board 410 included in the auxiliary panel 400 to enable a normal operation for providing elevator service to a passenger.

After that, in the divided construction work step 2, the old car device 300 is replaced with the new car device 300A. In this step, the old cable for the old car device 300 is removed from the auxiliary panel 400, and a new cable for the new car device 300A is connected to the new control panel 100A (see FIG. 11). Specifically, the old cable is replaced with the new cable, and the new control panel 100A and the new car device 300A are connected to each other through the new cable. After the new control panel 100A and the new car device 300A are connected to each other through the new cable, the new control panel 100A can control the new car device 300A through the new serial communication system, which is different from the old serial communication system at least in data transmission speed. Specifically, the new control panel 100A is configured to be communicable with the new devices through the new serial communication system.

Further, when the hall device is replaced in the divided construction work step 3, the old cable for the old hall device 200 and the relay harness 120A are removed from the new control panel 100A, and a new cable for the new hall device 200A is connected to the new control panel 100A (see FIG. 10). As described above, the old cable is replaced with the new cable, and the new control panel 100A and the new hall device 200A are connected to each other through the new cable.

As described above, with the relay harnesses 120A and 420, the cable for old devices can be connected to the new control panel 100A. Accordingly, the renewal with the continuous use of the cable for old devices can be achieved. In the auxiliary panel 400, the relay harness 420 may be formed separately from the communication conversion board 410, or may be formed integrally with the communication conversion board 410. When the communication conversion board 410 and the relay harness 420 are formed integrally with each other, the relay harness 420 has a connector compatible with the old cable for the old device so as to be connectable to the old cable.

(Divided Construction Work Step 4: Replacement of Traction Machine) and (Divided Construction Work Step 5: Work for Earthquake Safety)

Subsequently, for the elevator device described above, the traction machine is replaced in a divided construction work step 4 shown in FIG. 2. Specifically, in the divided construction work step 1, the old control panel 100 is replaced with the new control panel 100A. In the divided construction work step 2 and the divided construction work step 3, the old car device 300 and the old hall device 200 are replaced with the new car device 300A and the new hall device 200A, respectively. After that, in the divided construction work step 4, the old traction machine is replaced with the new traction machine. In this case, there is exemplified a case in which the old traction machine is replaced with the new traction machine. However, the traction machine is not necessarily required to be replaced, and the old traction machine may be continuously used.

Work for earthquake safety is carried out as a divided construction work step 5 as needed to thereby complete the renewal of the elevator.

The representative renewal construction method from the divided construction work step 1 to the divided construction work step 5 has been described above. Besides, a power failure emergency automatic hall device, which may be affected by a difference in power supply specifications of the elevator in the divided construction work step 1, is described.

The power failure emergency automatic hall device is a device configured to move a car to the nearest floor with a battery power supply to rescue a passenger in case of power failure. When a power failure is detected by the power failure emergency automatic hall device, power is supplied from an old battery device panel to the old control panel and a car control circuit in an old on-car station in an old elevator device and power is supplied from a battery in the new control panel to the new elevator control board and a car control circuit in a new on-car station in a new elevator device.

Accordingly, also in the divided construction work step 1, the car control circuit in the old on-car station is continuously used. Thus, the power is required to be supplied from the battery in the new control panel. However, power supply specifications are different due to a difference between the new control panel and the old control panel. Thus, the power cannot be supplied from the battery in the new control panel to the car control circuit in the old on-car station. Further, when the battery, which has the power supply specifications compatible with the car control circuit in the old on-car station, is used in the new control panel, the power cannot be supplied after the car control circuit in the old on-car station is replaced with the car control circuit in the new on-car station in the divided construction work step 2.

Figure 12:
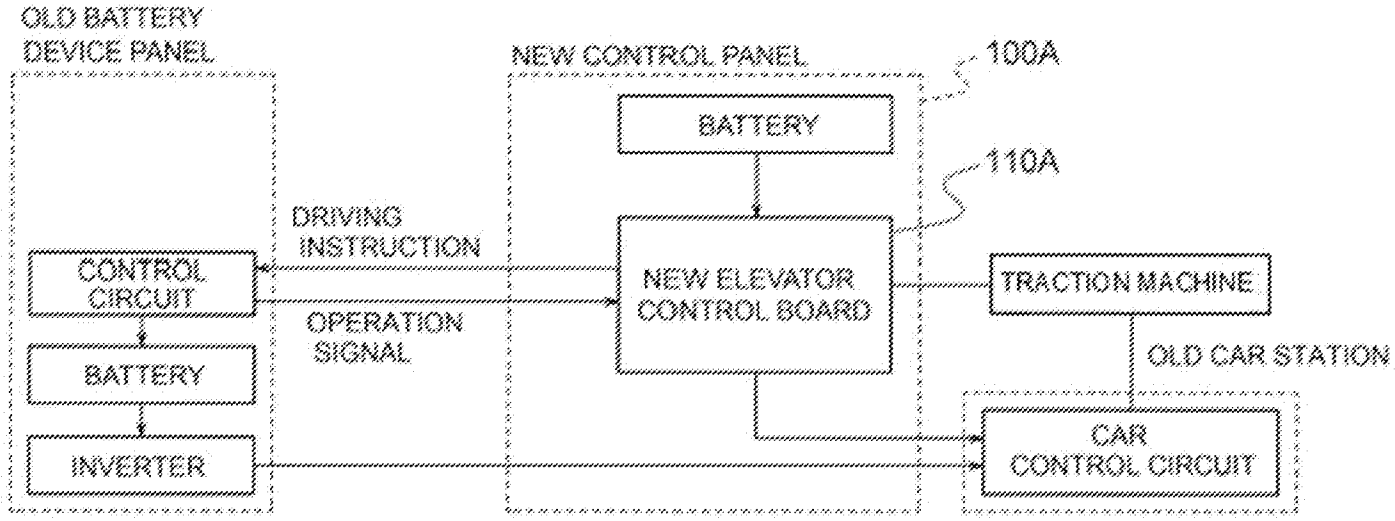
FIG. 12 is an explanatory diagram for illustrating a relationship between a new elevator device and an old battery device panel, to which the elevator renewal construction method according to the first embodiment of the present invention is applied.

Thus, only for the power for the car control circuit in the old on-car station, a system configured to supply the power from the old battery device is constructed. FIG. 12 is an explanatory diagram for illustrating a relationship between the new elevator device and the old battery device panel to which the elevator renewal construction method according to the first embodiment of the present invention is applied.

In FIG. 12, when the power failure is detected, the new elevator control board 110A of the new control panel 100A outputs a driving instruction (power failure emergency automatic hall instruction) to a control circuit of the old battery device panel. When the driving instruction is input to the control circuit of the old battery device panel, the power is supplied from a battery in the old battery device panel via an inverter to the car control circuit in the old on-car station and the control circuit of the old battery device panel outputs an operation signal (power failure emergency automatic hall operation signal) to the new elevator control board 110A.

In this manner, an operation of the new control panel 100A and an operation of the old battery device panel are synchronized with each other. When the operation signal is not input from the control circuit in the old battery device panel although the new elevator control board 110A outputs the driving instruction, it is determined that an abnormality has occurred.

After the old on-car station is replaced with the new on-car station in the divided construction work step 2, the old battery device panel is not required and is therefore removed.

As described above, according to the first embodiment, the elevator renewal construction method includes the steps of: dividing a process of the renewal construction work into the series of divided construction work steps each determined as such a unit that the elevator becomes normally operable every time after finishing of each of the divided construction work steps; and executing the renewal construction work in accordance with the series of divided construction work steps.

Further, according to the first embodiment, the elevator renewal construction method further includes the steps of: replacing the old control panel of the existing elevator with the new control panel; installing the auxiliary panel, which includes the communication conversion unit to be connected to the new control panel, and which is formed separately from the new control panel; and bringing the old device including at least any one of the old hall device and the old car device, which has been placed in a communicable state with the old control panel of the existing elevator, into a communicable state with the new control panel via the communication conversion unit.

Further, according to the first embodiment, the elevator auxiliary panel is formed separately from the elevator control panel including the elevator control unit configured to control the device in the elevator through the new serial communication system, which is different from the old serial communication system at least in data transmission speed, and includes the communication conversion unit, which is to be connected to the elevator control unit of the elevator control panel, and which is configured to mutually covert the communication system between the old serial communication system and the new serial communication system.

Thus, the elevator renewal construction method, with which the elevator can be used even during the elevator renewal construction period so that the continuous elevator out-of-service period in the elevator renewal construction period can be shortened, and the elevator auxiliary panel having the simple configuration, with which the cost can be reduced, can be obtained.

Further, in order to shorten the continuous elevator out-of-service period in the elevator renewal construction period, the renewal construction work is divided into the plurality of divided construction work steps. As a result, a working area for each of the divided construction work steps can be limited to a specific area. Thus, workability can be improved.

Further, after the auxiliary panel including the communication conversion board is no longer needed, the auxiliary panel may be removed from a present place so as to be reused for renewal construction work at another place. As a result, the cost can be reduced, and the resource saving measures can be implemented.

In the embodiment described above, the application of the present invention to the case in which the old car device is replaced with the new car device and the case in which the old hall device is replaced with the new hall device has been exemplified. However, the present invention is applicable to, for example, a case in which an old optional device other than the hall device and the car device is replaced with a new optional device.

In the embodiment described above, the serial communication has been exemplified as each of the old communication system and the new communication system. However, the communication system is not limited to the serial communication. The present invention is applicable to a communication system other than the serial communication.

REFERENCE SIGNS LIST

1 machine room, 2 traction machine, 3 control panel, 4 speed governor, 5 hoistway, 6 car, 7 counterweight, 8 main rope, 9 guide rail, 10 terminal slowdown switch, 11 door driving device, 12 car operating panel, 13 hall, 14 hall operating panel, 15 pit, 16 buffer, 17 traveling cable, 18 on-car station, 19 floor, 20 cinder concrete, 21 support leg, 22 support plate, 23 fixing member, 24 fixing member, 25 tension rod, 26 ceiling, 100 old control panel, 100A new control panel, 110 old elevator control board, 110A new elevator control board (elevator control unit), 120A relay harness, 200 old hall device, 200A new hall device, 300 old car device, 300A new car device, 400 auxiliary panel, 410 communication conversion board (communication conversion unit), 411 CPU, 412 RAM, 420 relay harness

The invention claimed is:

1. An elevator renewal construction method, in which, when renewing at least one device in an existing elevator, process of renewal construction work is divided into a series of divided construction work steps, each being determined as such a unit that the elevator operation becomes normally possible after finishing of each of the divided construction work steps, and the renewal construction works are executed in accordance with the series of divided construction work steps, the series of the divided construction work steps including a first divided construction work step, the first divided construction work step comprising the steps of:

replacing an old control panel of the existing elevator with a new control panel;

installing an auxiliary panel, which includes a communication converter to be connected to the new control panel, and which is formed separately from the new control panel; and connecting an old device including at least any one of an old hall device and an old car device, which has been placed in a communicable state with the old control panel of the existing elevator, to the communication converter of the auxiliary panel to bring the old device into a communicable state with the new control panel via the communication converter so as to bring the elevator into a normally operable state after finishing of the first divided construction work step in a renewal construction period, wherein the new control panel is configured to be communicable with the old device through an old communication system converted via the communication converter included in the auxiliary panel, the communication converter being configured to mutually convert a communication system between a new communication system and the old communication system, and wherein the auxiliary panel is configured to be removable from a present place so as to be reusable for renewal construction work at another place.

2. The elevator renewal construction method according to claim 1, wherein the series of divided construction work steps are determined so that each of the divided construction work steps is completed in corresponding one of a series of construction periods, which are each being ensured without interruption for each renewal construction work day in a renewal construction period.

3. The elevator renewal construction method according to claim 1, wherein, in the step of bringing the old device into the communicable state with the new control panel via the communication converter, the communication converter is connected to the old device through an old cable for the old device.

4. The elevator renewal construction method according to claim 3, wherein, when the old device and the communication converter are connected to each other through the old cable, the old cable is connected to the communication converter via a relay harness having a connector compatible with the old cable.

5. The elevator renewal construction method according to claim 1, further comprising the steps of:

replacing the old device with a new device, which includes at least any one of a new hall device and a new car device, and which corresponds to the old device to be replaced; and bringing the new device into a communicable state with the new control panel without via the communication converter of the auxiliary panel, wherein the new control panel is configured to be communicable with the new device through the new communication system.

6. The elevator renewal construction method according to claim 5, wherein, in the step of bringing the new device into the communicable state with the new control panel, the old cable is replaced with a new cable, and the new device and the new control panel are connected to each other through the new cable.

7. The elevator renewal construction method according to claim 1, wherein the new communication system is different from the old communication system at least in data transmission speed.

8. The elevator renewal construction method according to claim 1, wherein, in the step of installing the auxiliary panel, the auxiliary panel is fixed onto a fixing member inserted between a support plate arranged on support legs configured to support the new control panel and the new control panel.

9. The elevator renewal construction method according to claim 1, wherein, in the step of installing the auxiliary panel, the auxiliary panel is fixed by fixing a top of the auxiliary panel to a fixing member mounted to a side of the new control panel.

10. The elevator renewal construction method according to claim 1, wherein, in the step of installing the auxiliary panel, the auxiliary panel is fixed by tension rods, which are provided between a top of the auxiliary panel and a ceiling so as to apply forces to the top of the auxiliary panel and the ceiling.

11. The elevator renewal construction method according to claim 1, further comprising a step of removing the auxiliary panel after the auxiliary panel is no longer needed.

12. An elevator renewal construction method for renewing at least one device in an existing elevator, comprising the steps of:

replacing an old control panel of the existing elevator with a new control panel;

installing an auxiliary panel, which includes a communication converter to be connected to the new control panel, and which is formed separately from the new control panel, in a different location from the new control panel; and connecting an old device including at least any one of an old hall device and an old car device, which has been placed in a communicable state with the old control panel of the existing elevator, to the communication converter of the auxiliary panel to bring the old device into a communicable state with the new control panel via the communication converter so as to bring the elevator into a normally operable state in a renewal construction period, wherein the new control panel is configured to be communicable with the old device through an old communication system converted via the communication converter included in the auxiliary panel, the communication converter being configured to mutually convert a communication system between a new communication system and the old communication system.

* * * * *